US006062039A

United States Patent [19]

Haramoto et al.

[11] Patent Number: 6,062,039

[45] Date of Patent: May 16, 2000

[54] UNIVERSAL ACCUMULATOR FOR AUTOMOBILE AIR CONDITIONING SYSTEMS

[75] Inventors: Cary Haramoto, Newark; Gary E. Griffin, Penn Yan; Walter S. Crothers, Farmington, all of N.Y.

[73] Assignee: Parker-Hannifin Corporation, Cleveland, Ohio

[21] Appl. No.: 09/221,819

[22] Filed: Dec. 29, 1998

Related U.S. Application Data

[60] Provisional application No. 60/070,678, Jan. 7, 1998.

[51] Int. Cl.[7] ..... F25B 43/00

[52] U.S. Cl. ..... 62/503; 62/512

[58] Field of Search ..... 62/512, 503

[56] References Cited

U.S. PATENT DOCUMENTS

| | | |
|---|---|---|
| 934,679 | 9/1909 | Lea . |
| 1,202,577 | 10/1916 | Peschman . |
| 1,938,711 | 12/1933 | MxMurray . |
| 3,030,754 | 4/1962 | Root et al. . |
| 3,177,680 | 4/1965 | Rasovich et al. . |
| 3,270,884 | 9/1966 | Bremer . |
| 3,283,524 | 11/1966 | Byron . |
| 3,296,777 | 1/1967 | Jackson et al. . |
| 3,422,382 | 1/1969 | Rosaen . |
| 3,477,208 | 11/1969 | Keller, Sr. . |
| 3,618,297 | 11/1971 | Hamrick . |
| 3,643,465 | 2/1972 | Bottum . |
| 3,698,207 | 10/1972 | Melnyk . |
| 3,837,177 | 9/1974 | Rockwell et al. . |
| 3,872,689 | 3/1975 | Bottum . |
| 3,981,061 | 9/1976 | Jackson et al. . |
| 4,111,005 | 9/1978 | Livesay . |
| 4,122,579 | 10/1978 | Parise . |
| 4,182,136 | 1/1980 | Morse . |
| 4,187,088 | 2/1980 | Hoddgson . |
| 4,194,370 | 3/1980 | Morse . |
| 4,194,371 | 3/1980 | Morse . |
| 4,199,960 | 4/1980 | Adams et al. . |

(List continued on next page.)

*Primary Examiner*—Mark Shulman
*Attorney, Agent, or Firm*—Christopher H. Hunter

[57] ABSTRACT

An accumulator for a refrigeration system includes a housing having a cylindrical sidewall, a lower end wall, and an upper end cap. Inlet and outlet passages are provided in the upper end cap for directing refrigerant into and out of the accumulator. A U-shaped return conduit is provided in the accumulator for directing vapor or gaseous refrigerant out of the accumulator. A baffle having a central circular opening is retained between a circular bead on the return conduit and the upper end cap. The circular bead surrounds the conduit toward the outlet end of the conduit. The return conduit is introduced through the central opening in the baffle until the bead contacts the inside surface of the baffle around the central opening. The outlet end of the return conduit is then introduced into the outlet passage in the upper end cap and secured therein such as by mechanically deforming (e.g., burnishing) the conduit outwardly against the inner wall of the passage. The baffle is trapped between the bead on the return conduit and the inside surface of the upper end cap in a secure and fluid-tight manner.

23 Claims, 3 Drawing Sheets

U.S. PATENT DOCUMENTS

| | | | |
|---|---|---|---|
| 4,214,883 | 7/1980 | Raseley et al. . | |
| 4,236,381 | 12/1980 | Imral et al. | 62/503 |
| 4,270,934 | 6/1981 | Widdowson et al. . | |
| 4,276,756 | 7/1981 | Livesay . | |
| 4,291,548 | 9/1981 | Livesay . | |
| 4,354,362 | 10/1982 | Schumacher et al. | 62/503 |
| 4,474,035 | 10/1984 | Amin et al. . | |
| 4,475,360 | 10/1984 | Suefuji et al. | 62/503 |
| 4,496,378 | 1/1985 | Kish . | |
| 4,583,377 | 4/1986 | Viegas | 62/503 |
| 4,619,673 | 10/1986 | Cullen et al. . | |
| 4,622,136 | 11/1986 | Karcey . | |
| 4,627,247 | 12/1986 | Morse . | |
| 4,651,540 | 3/1987 | Morse . | |
| 4,827,725 | 5/1989 | Morse . | |
| 4,911,739 | 3/1990 | Cullen et al. . | |
| 5,092,911 | 3/1992 | Williams et al. . | |
| 5,134,859 | 8/1992 | Jaster . | |
| 5,179,844 | 1/1993 | Lyman et al. . | |
| 5,184,479 | 2/1993 | Koberstein et al. . | |
| 5,184,480 | 2/1993 | Kolpacke . | |
| 5,201,195 | 4/1993 | Gavlak et al. . | |
| 5,201,792 | 4/1993 | Study . | |
| 5,275,642 | 1/1994 | Bassine . | |
| 5,282,370 | 2/1994 | Kiblawi et al. . | |
| 5,748,065 | 5/1998 | Patel et al. . | |

UNIVERSAL ACCUMULATOR FOR AUTOMOBILE AIR CONDITIONING SYSTEMS

RELATED CASES

The present application claims priority to U.S. Provisional Application Ser. No. 60/070,678, filed Jan. 7, 1998.

FIELD OF THE INVENTION

This invention relates generally to refrigeration and air-conditioning systems, and more particularly to accumulators for automotive air conditioning systems.

BACKGROUND OF THE INVENTION

Conventional refrigeration and air-conditioning systems include a compressor, a condenser, an expansion device, and an evaporator. Refrigerant is circulated through the system to produce cooling. Energy is provided to the system by the compressor which serves to create a source of high pressure gas refrigerant which is allowed to pass through the condenser. The refrigerant dissipates heat in the condenser and changes state to a high pressure liquid. The refrigerant then passes through the expansion device and into the evaporator where the refrigerant changes from a high pressure liquid to a low pressure liquid, and subsequently to a low pressure gas. The change of state removes heat from the area surrounding the evaporator. The refrigerant is then drawn from the evaporator back to the compressor in a low pressure gas form, where it is again compressed into high pressure gas for repetition of the cycle.

An accumulator is normally located between the evaporator and the compressor in the system. The accumulator ensures that only refrigerant in a gas or vapor stage passes into the compressor, as refrigerant from the outlet of the evaporator often includes both a liquid component and a vapor component. In some accumulators, the vapor component is collected in the upper region of the accumulator, while the liquid component, along with any lubricating oil, drains to the lower region of the accumulator. The vapor component of the refrigerant is removed from the upper region of the accumulator by a U-shaped return conduit. The return conduit typically includes a metering device (e.g., a bleed-through orifice) at the lower portion thereof which draws a small amount of oil and liquid refrigerant back into the return conduit for lubrication of the downstream components, for example, the compressor.

One drawback associated with some accumulators has been that under certain operating circumstances, such as during start-up, incoming refrigerant enters the accumulator at high velocities and if directed at the stored liquid refrigerant, can disrupt and splash the stored liquid refrigerant. Such splashing can cause uncontrolled return of the refrigerant through the return conduit to the compressor, which is undesirable in certain circumstances.

To prevent this, some accumulators include a baffle (or deflector) which is supported within the inlet stream of refrigerant. The baffle prevents the incoming refrigerant from impacting directly against the stored liquid refrigerant, and instead attempts to direct the incoming refrigerant into the stored liquid smoothly. The baffle also facilitates separating the gaseous refrigerant from the liquid refrigerant.

On particularly useful accumulator is illustrated in U.S. Pat. Nos. 5,076,071; 4,827,725; 4,651,540; and 4,627,247. These patents show a circular baffle disposed at the upper part of the accumulator housing. The incoming refrigerant is introduced into the housing axially through the upper end cap and redirected by the baffle tangentially to the inside walls of the housing. The baffle includes a central circular aperture with a shoulder portion which engages the outlet end of the return conduit. The baffle has an upper spiral or helical surface around the central opening which receives the incoming refrigerant, and directs the refrigerant in a spiralling downward path along the inside surface of the housing. The liquid flows downwardly to join the liquid stored in the lower portion of the housing, and liquid refrigerant is separated from the gaseous refrigerant by centrifugal force. The spiraling refrigerant smoothly enters the stored liquid without substantial splashing, and thus without causing uncontrolled return of the liquid refrigerant to the compressor. It is also believed that the spiral baffle in the accumulator facilitates separating gaseous refrigerant from liquid refrigerant.

While the above type of accumulator has received widespread acceptance in the marketplace, the baffle is supported against both the upper end of the return conduit and the inside surface of the upper end cap. The return conduit is itself supported at the lower end of the housing. The baffle must be closely fit (sealed) against the upper end cap and the return conduit to prevent leakage. This requires relatively tight control of the tolerances between the return conduit, baffle and upper end cap in order to manufacture and assemble the accumulator. Such tight control of the tolerances can increase the manufacturing steps, labor costs, and generally the over-all costs of the accumulator.

In addition, the baffle is sometimes brazed to the end cap to facilitate fluidly sealing the baffle to the end cap. This can also require extra manufacturing steps and increase the labor costs.

As such, it is believed there is a demand in the industry for a further improved accumulator which provides controlled introduction of the liquid refrigerant into the stored liquid, but which allows greater tolerance stack-ups between components, particularly between the baffle, upper end cap and return conduit, so as to reduce the manufacturing and assembly costs. It is also believed there is a demand in the industry for an accumulator with reduced assembly steps, such as the elimination of the brazing step between the baffle and the upper end cap, so as to also reduce manufacturing and assembly costs. In any case, it is believed that there is a continual demand for an efficient and low-cost accumulator which effectively separates gaseous refrigerant from liquid refrigerant.

SUMMARY OF THE INVENTION

The present invention provides an improved accumulator for refrigeration and air-conditioning systems, and in particular provides an improved accumulator having a unique structure for the return conduit, cylindrical baffle, and upper end cap. The structure provides for easily and consistently assembling the return conduit and baffle within the accumulator, allows greater tolerance stack-ups between components and eliminates having to separately secure the baffle to the upper end cap, such as through an additional brazing step. The accumulator is also relatively easy to manufacture, and maintains controlled introduction of the entering refrigerant into the stored refrigerant to effectively separate liquid refrigerant from gaseous refrigerant.

According to the preferred embodiment of the present invention, the cylindrical baffle is retained in sealing relation with the upper end cap by a circular bead formed on the return conduit. The circular bead surrounds the conduit and is formed toward the outlet end of the conduit. The return conduit is introduced through a central, circular opening in the baffle until the bead contacts the inside surface of the baffle around the central opening. The outlet end of the return conduit is then introduced into the outlet passage in the upper end cap and secured therein such as by mechanically deforming (e.g., burnishing) the conduit outwardly against the inner wall of the passage. The conduit can also be secured within the outlet passage by other means, such as by using complimentary screw threads on the return conduit and outlet passage and screwing the return conduit into the outlet passage in the upper end cap.

In any case, the baffle is trapped between the bead on the return conduit and the inside surface of the upper end cap in a secure and fluid-tight manner without having to separately secure the baffle to the end cap such as by brazing. The return conduit is fully supported by the upper end cap (and not by the lower end wall of the accumulator), which allows greater tolerance stack-up between these components. The unique return conduit, baffle and upper end cap structure is relatively straightforward and economical to manufacture and assemble, which generally reduces the over-all costs associated with the accumulator.

The accumulator housing for the present invention preferably include an upper end cap, a lower end wall, and a cylindrical sidewall interconnecting the end cap and lower end wall. The lower end wall is preferably formed in one piece with the cylindrical sidewall, while the upper end cap (with assembled return conduit and baffle) is secured to the sidewall such as by brazing or welding. The return conduit preferably has a U-shape, with the outlet end secured to the upper end cap of the accumulator housing, and an inlet end disposed within the internal chamber of the housing, generally below and shielded by the baffle. A metering device is provided at the lower end of the return conduit to meter a controlled amount of oil entrained in the stored liquid back to the compressor.

Again, the return conduit, baffle and end cap structure of the accumulator described above are relatively easy to manufacture and assemble with the accumulator, which reduces the costs of the accumulator. By imparting a tangential flow component to the incoming refrigerant to direct the refrigerant in a spiraling manner around the inside surface of the accumulator sidewall, liquid refrigerant is also effectively separated from the gaseous refrigerant.

Further features and advantages of the present invention will be apparent upon reviewing the following detailed description and accompanying drawings.

DETAILED DESCRIPTION OF THE PREFERRED EMBODIMENT

Figure 1:
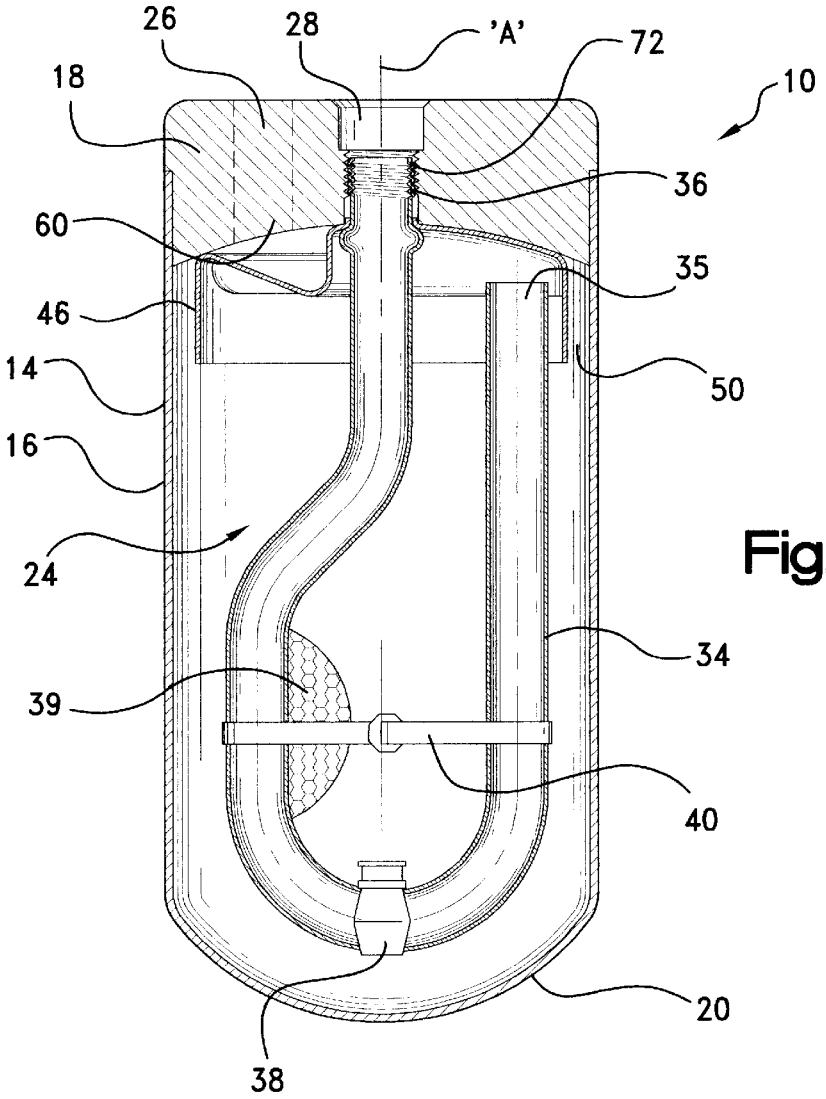
FIG. 1 is a cross-sectional side view of an accumulator constructed according to the present invention.
Figure 3:
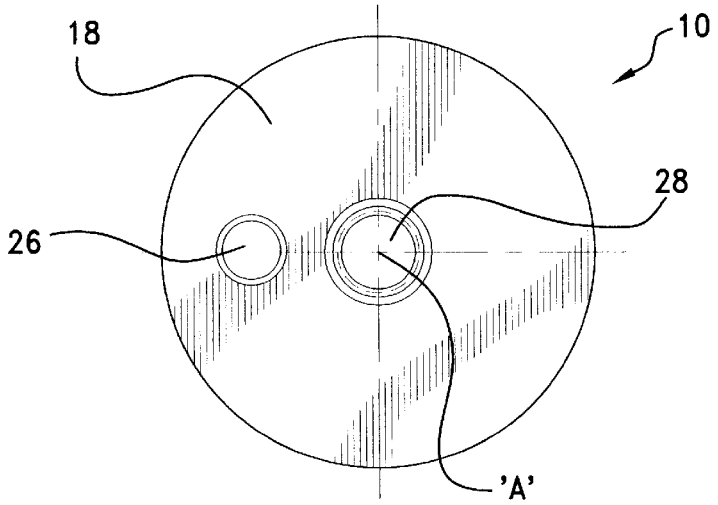
FIG. 3 is a top plan view of the accumulator of FIG. 1.
Figure 2:
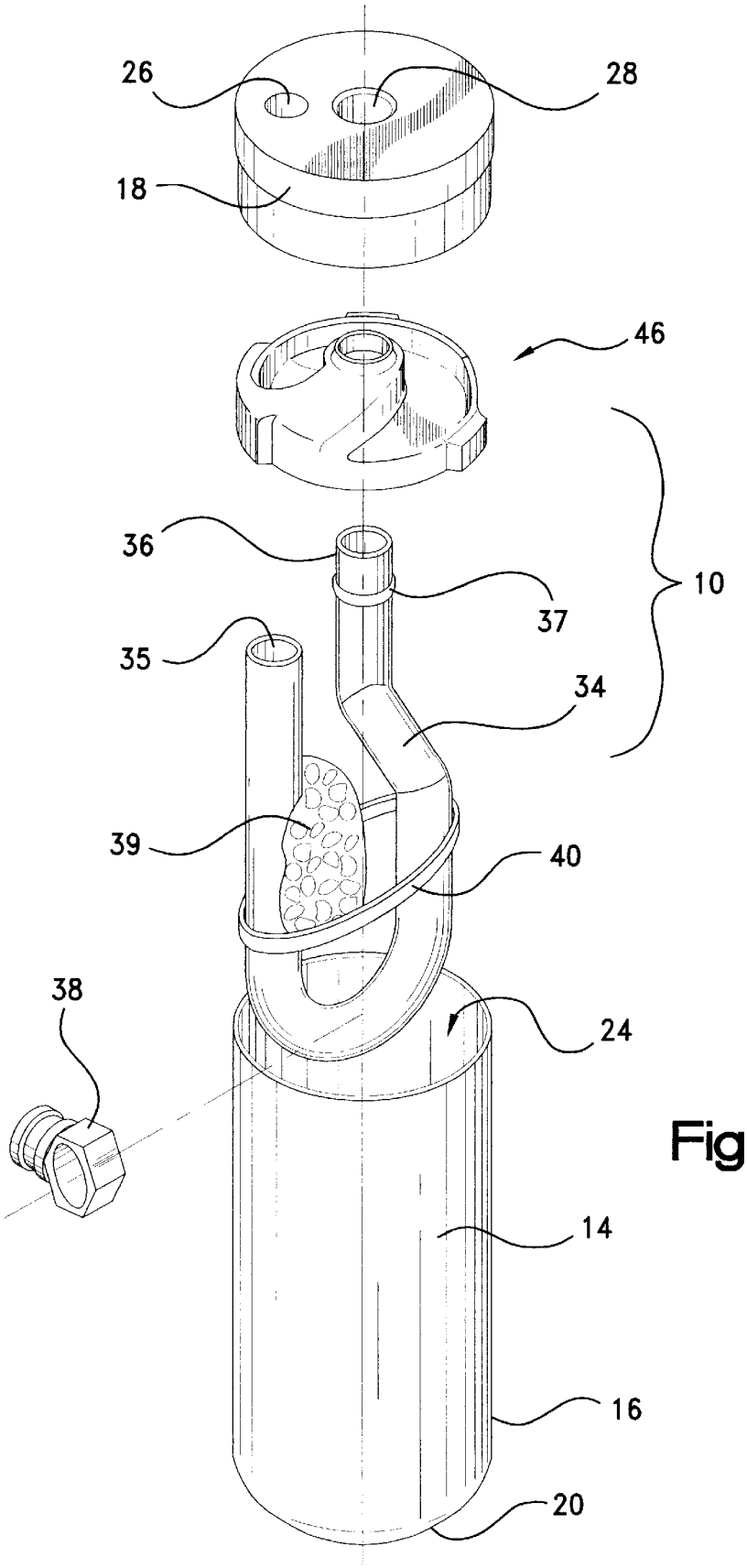
FIG. 2 is a perspective view of certain components of the accumulator of FIG. 1, prior to being assembled within the accumulator housing.

Referring to the drawings and initially to FIGS. 1–3, an accumulator constructed according to the principles of the present invention is illustrated generally at 10. The accumulator includes an outer housing 14 comprising a cylindrical sidewall or shell 16 surrounding a central longitudinal axis "A", an upper end cap 18 and a lower end wall 20. Cylindrical sidewall 16 and lower end wall 20 are preferably formed together in one piece using common metal-forming techniques such as impacting or extruding a sheet of metal. Upper end cap 18 is preferably formed separately from sidewall 16 and end wall 20 also using common metal-forming techniques such as stamping, impacting or forging, and then fixedly attached to cylindrical sidewall 16 in a fluid-tight manner using common techniques such as welding or brazing. The upper end cap 18, lower end wall 20 and cylindrical sidewall 16 define an internal cavity, indicated generally at 24 (FIG. 1).

The accumulator 10 is designed to be incorporated within refrigeration and air-conditioning systems (together "refrigeration systems"), typically between the outlet side of the evaporator and the inlet side of the compressor. As should be known to those skilled in the art, the accumulator is generally designed to store excess liquid in the refrigeration system, and pass vaporous or gaseous refrigerant to the compressor.

The accumulator 10 includes an inlet passage 26 for directing refrigerant in a liquid and vapor (or gas) state into cavity 24 of accumulator 10, and an outlet passage 28 for directing vapor refrigerant out of cavity 24. The inlet and outlet passages 26, 28 are preferably formed axially through the upper end cap 18. Outlet passage 28 is preferably formed generally along the central axis "A" of the accumulator, while inlet passage 26 is located radially outward from the central axis, that is, radially outward from outlet passage 28. Appropriate fittings (not shown) are provided for the inlet and outlet passages such that the accumulator can be connected within the refrigeration system.

A return conduit 34, which is preferably a U-shaped metal tube, is provided for directing vaporous refrigerant out of cavity 24. Return conduit 34 includes an inlet end 35 which receives vaporous refrigerant from cavity 24, and an outlet end 36 which directs the gaseous refrigerant to outlet passage 28. A circular bead 37 is provided proximate outlet end 36. Bead 37 can be formed in conduit 34 using a common end forming machine, or by any other appropriate means, and continuously surrounds the conduit substantially perpendicular to the axis of the conduit. The reasons for bead 37 will be more fully described below.

A metering device 38 is provided at the lower end of the U-shaped return conduit 34. The metering device 38 can be a bleed orifice or other common device which is designed to meter a controlled amount of oil in the stored refrigerant (as well as a controlled amount of liquid refrigerant) into the return conduit for return to the compressor.

A desiccant 39, preferably contained within a bag or pouch, is also disposed within cavity 24 and can be supported along return conduit 34 by a tie strap 40. Desiccant 39 absorbs any water that may be present in the refrigerant in cavity 24. Desiccant 39 can be any appropriate, commercially-available type of desiccant which should be well-know by those skilled in the art.

A cylindrical metal baffle, indicated generally at 46, is mounted within cavity 24 toward the upper end of housing 14. Baffle 46, as will be described below, is designed to redirect fluid entering axially from inlet passage 26 tangentially around the sidewall 16.

Figure 4:
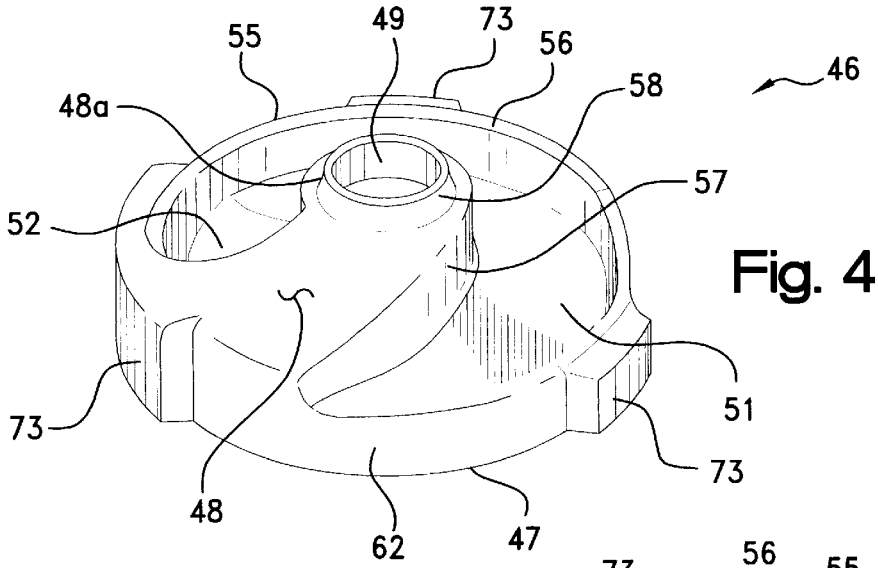
FIG. 4 is a elevated perspective view of a first form of the baffle for the accumulator of FIG. 1.
Figure 5:
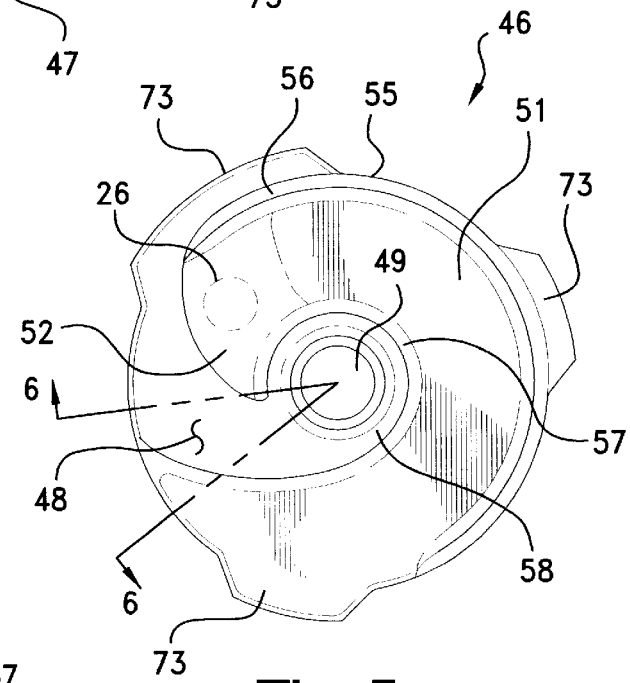
FIG. 5 is top view of the baffle of FIG. 4.
Figure 6:
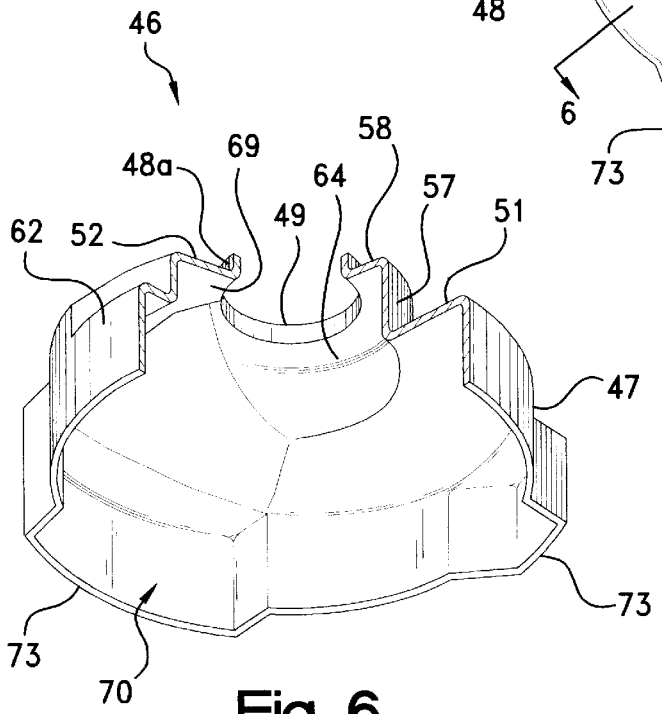
FIG. 6 is a cross-sectional side view of the baffle taken substantially along the plane defined by the lines 6—6 in FIG. 5.

Referring now to FIGS. 4–6, a preferred form of baffle 46 is shown having a generally circular metal or plastic body 47 with a generally dome-shaped upper surface 48 and a short, axially-extending annular collar or flange 48*a* defining a central circular opening 49. An annular gap 50 (FIG. 1) is provided between baffle 47 and the inside surface of sidewall 16. A spiraling ramp surface 51 with a sloping end surface 52 is formed in the upper surface 48 in surrounding relation to opening 49. As apparent from FIGS. 1 and 5, sloping end surface 52 is aligned with inlet passage 26 when baffle 46 is located within housing 14, such that fluid directed through inlet passage 26 impacts directly against sloping end surface 52. The sloping end surface 52 and spiraling ramp surface 51 are initially outwardly bounded by a short arcuate sidewall segment 55 having a flat upper edge 56. Sidewall segment 55 tapers downwardly to the level of ramp surface 51 after extending along a short peripheral edge portion of baffle body 47. The sloping end surface 52 and spiraling ramp surface 51 are also inwardly bounded by an inner sidewall 57, which initially surrounds opening 49 and then curves in an outwardly-extending arcuate manner toward the periphery of the baffle body, and also tapers downwardly to the level of ramp surface 51. The inner sidewall 57 has an annular upper edge surrounding collar 48*a* with a flat upper surface 58.

The upper end cap 18 of the accumulator includes an inner, dome-shaped surface 60 which substantially matches the dome-shaped upper surface 48 of baffle 46. Baffle 46 is located within housing 14 such that upper surface 58 of inner sidewall 57 and the upper edge 56 of outer sidewall segment 55 are disposed in surface-to-surface, sealing relationship with the inside surface 60 of the end cap. The collar 48*a* defining opening 49 is received within and extends partially into outlet passage 28 in upper end cap 18. The upper edge 56 of outer sidewall segment 55 seals against the inside surface 60 around a portion of the periphery of the baffle, at least until the segment 55 begins to taper downwardly to the level of the ramp surface 51. Likewise, upper surface 58 of inner sidewall 57 seals against the inside surface 60 around the entire extent of opening 49. Inner sidewall 57 generally fluidly seals opening 49 from fluid entering the accumulator to prevent fluid from passing directly from inlet passage 26 to outlet passage 28.

When baffle 46 is located against upper end cap 18, the inner sidewall 57, outer sidewall 55, spiraling ramp surface 51, sloping end surface 52 and inside surface 60 of upper end cap 18 confine and direct fluid introduced through inlet passage 26 and impacting on sloping end surface 52 to follow the spiraling path of the ramp surface 51. Baffle 46 deflects the incoming fluid through axial inlet passage 26 ninety (90) degrees to a flow path essentially tangential to the sidewall of the accumulator. As outer sidewall segment 55 tapers toward ramp surface 51, the fluid then smoothly transitions outward against housing sidewall 16, still in a spiraling manner. The fluid continues its spiral path downward through annular gap 50 between body 47 and sidewall 16 into the lower portion of the accumulator, where it is smoothly introduced into the stored refrigerant.

Baffle 46 further includes a cylindrical skirt or flange 62 extending downwardly around the periphery of body 47. Skirt 62 is preferably formed in one piece with body 47 using conventional forming techniques, for example stamping, impacting or forging. The inner surface of skirt 62 and the lower surface of body 47 define a lower cavity, indicated generally at 63. The upper edge of inner sidewall 57 also has a flat lower surface 64 which is generally parallel to upper surface 58, and an annular shoulder 69 which smoothly curves between and interconnects lower flat surface 64 and collar 48*a*(see FIG. 6).

The inlet end 35 of return conduit 34 extends upwardly into cavity 63 and is substantially shielded by skirt 62 from refrigerant directed from baffle 46. The outlet end 36 of the return conduit also extends upwardly into cavity 63 and is closely received in central opening 49. Return conduit 34 is inserted through opening 49 until circular bead 37 engages flush against the annular curved shoulder 69 surrounding opening 49. Shoulder 69 facilitates locating bead 37 centrally within the opening 49 and in sealing bead 37 to baffle 46. The outlet end 36 of return conduit 34 is then inserted into outlet passage 28 in upper end cap 18 and secured therein, supporting the outlet end of the return conduit along the central axis of the accumulator and trapping the baffle 46 against the upper end cap 18. Bead 37 urges flat upper surface 58 of inner sidewall 57 and the flat upper surface 56 of sidewall segment 55 against the inside surface 60 of the upper end cap to create fluid-tight seal between the baffle 46 and the upper end cap 18.

The return conduit can be secured within outlet passage 28 in any appropriate manner. It is preferred that the outlet passage be mechanically secured such as by roller burnishing the return conduit outwardly against the inside surface of the passage. Appropriate threads, indicated at 72 in FIG. 1, can be provided around the inside surface of the passage for this purpose. Other mechanical techniques could also be used, such as providing complimentary screw threads on both the outlet end of the return conduit as well as the outlet passage and screwing the outlet conduit into the end cap, or non-mechanical means could also be used, such as brazing or welding, although these are less preferred. In any case, the return conduit is urged inwardly into outlet passage 28 to such an extent that the upper surface 48 of baffle 46 is securely and sealingly held against the inside surface 60 of the upper end cap. If necessary or desirable, the baffle and upper end cap can have cooperating structure, such as a pin-and-groove, which would prevent the baffle from rotating with respect to the end cap and to facilitate locating the baffle such that inlet passage 26 is properly rotationally aligned with sloping end portion 52.

If necessary or desirable, one or more ridges or supports 73 can be formed with skirt 62 of body 47 and extend radially outward to facilitate centering the baffle within the housing 14 and supporting the side of the baffle against the sidewall 16. Ridges 73 are small enough so as to not substantially interfere with the smooth introduction of the refrigerant into the lower portion of the accumulator.

As should be apparent from the above, the accumulator is relatively easy to manufacture and assemble. It is preferred that the return conduit, baffle and upper end cap be pre-assembled prior to being inserted within the accumulator housing 14. After these components are pre-assembled, the desiccant bag can then be positioned between the vertical conduit portions of the return conduit and secured with a tie strap. The upper end cap is then secured to the housing 14 in an appropriate manner, such as by brazing or welding. In this manner, the accumulator can be easily assembled with a minimum of steps and without additional internal brazing steps. This reduces the assembly time and effort, which reduces the over-all costs associated with the accumulator. By imparting a tangential flow component to the incoming refrigerant to direct the refrigerant in a spiraling manner around the inside surface of the accumulator the accumulator also effectively separates liquid refrigerant from the gaseous refrigerant.

The principles, preferred embodiments and modes of operation of the present invention have been described in the foregoing specification. The invention which is intended to be protected herein should not, however, be construed as limited to the particular form described as it is to be regarded as illustrative rather than restrictive. For example, while inlet passage 26 is formed axially through upper end cap 18, it is also possible to form this passage radially through the upper end cap, or even radially through the upper end of housing 14, and direct the inlet refrigerant radially inward to sloping end portion 52, and then spirally along ramp surface 51, in the same manner as described for an axial inlet passage. Variations and changes may be made by those skilled in the art without departing from the scope and spirit of the invention as set forth in the appended claims.

What is claimed is:

1. An accumulator, comprising:

a cylindrical housing circumscribing a central axis and having first closed end and a second open end;

an end cap secured to the open end of the housing;

an inlet passage into the housing;

an outlet passage from the housing, said outlet passage including an opening formed through said end cap;

a baffle with a central axis generally aligned with the central axis of the housing, said baffle confining fluid which flows into said housing through said inlet passage, and having a configuration which deflects the fluid as it enters the housing and provides a generally spiraling flow path to the fluid; and a return conduit disposed within said housing, said return conduit having a first end which extends through an opening formed in said baffle and into the opening in the end cap in secured relation with the end cap, said return conduit having a circular bead surrounding the return conduit toward the first end which supports a lower surface of the baffle around the baffle opening such that an upper surface of the baffle is retained against the end cap of the housing.

2. The accumulator as in claim 1, wherein said return conduit extends into the opening formed in the end cap and is outwardly mechanically deformed within said opening into securing engagement with the end cap.

3. The accumulator as in claim 2, wherein said return conduit is burnished within said opening into securing relation with said end cap.

4. The accumulator as in claim 1, wherein the outer surface of the baffle and an inner surface of the end cap have opposing matching surface configurations such that the outer surface of the baffle is held in surface-to-surface contact with the inner surface of the end cap.

5. The accumulator as in claim 1, wherein the opening in the baffle is formed generally along the central axis of the baffle.

6. The accumulator as in claim 1, wherein said inlet passage also includes an opening formed through said end cap.

7. The accumulator as in claim 1, wherein said baffle comprises a generally circular body supported substantially perpendicular to the central axis of the housing, and a flow gap is provided between the outer periphery of the baffle and the housing to allow fluid to flow therebetween.

8. The accumulator as in claim 1, wherein said baffle and end cap cooperate to confine fluid which flows into the housing and to redirect the fluid in a spiraling manner.

9. An accumulator, comprising:

a cylindrical housing circumscribing a central axis and having first closed end and a second open end;

a generally circular end cap secured to the open end of the housing, said end cap also having a central axis generally aligned with the central axis of the housing;

an axial inlet passage into the housing, said inlet passage including a first opening formed through said end cap spaced from the central axis of the end cap;

an axial outlet passage from the housing, said outlet passage including a second opening formed through said end cap generally along the central axis of the end cap;

a generally circular baffle disposed within an upper portion of the housing, said baffle having a central axis generally aligned with the central axis of the housing, and an opening along the central axis, said baffle confining fluid from the inlet passage between a spiral surface area of the baffle surrounding the baffle opening and the end wall of the housing, the spiral surface area of the baffle deflecting the fluid tangentially to the housing as the fluid enters from the axial inlet passage and providing a generally spiraling flow path for the fluid in the housing, said baffle and cylindrical housing being spaced apart to define a flow gap and allow fluid in the spiraling flow path to flow to a lower portion of the housing; and a U-shaped return conduit disposed within said housing, said return conduit extending through the opening in said baffle and having a first end extending into the opening in the end cap and mechanically secured therein, said return conduit having a circular bead surrounding the return conduit toward the first end which engages and supports a lower surface of the baffle around the baffle opening such that the baffle is trapped between and against the bead and the end cap of the housing.

10. The accumulator as in claim 9, wherein said return conduit extends into the opening formed in the end cap and is outwardly mechanically deformed within said into securing engagement with the end cap.

11. The accumulator as in claim 10, wherein said return conduit is burnished within said opening into securing relation with said end cap.

12. The accumulator as in claim 9, wherein the outer surface of the baffle and an inner surface of the end cap have opposing matching surface configurations such that the outer surface of the baffle is held in surface-to-surface contact with the inner surface of the end cap.

13. A method for assembling an accumulator, comprising the steps of:

providing a cylindrical housing having a closed end and an open end;

providing a circular end cap for the open end of the housing, the end cap having a central opening;

providing a U-shaped return conduit having a circular bead formed around the tube toward one end;

providing a baffle having a lower surface, an upper surface with a spiral surface configuration, and a central opening interconnecting the upper and lower surfaces;

inserting the end of the return conduit through the central opening from the lower surface of the baffle, said return conduit passing through the opening, with the bead on the conduit sized so as to engage the lower surface surrounding the opening;

inserting the end of the return conduit passing through the opening in the baffle into the opening in the end cap, thereby trapping the baffle between the bead on the return conduit and the end cap;

securing the return conduit to the end cap; and locating the return conduit and the end cap in the housing and securing the end cap to the open end of the housing.

14. The method as in claim 13, including the step of mechanically deforming the end of the outlet conduit within the opening in the end cap such that the outlet conduit is secured to the end cap.

15. The accumulator as in claim 1, wherein the return conduit has a cylindrical shape and the circular bead projects radially-outward from the return conduit.

16. The accumulator as in claim 1, wherein the circular bead is spaced from the first end of the return conduit.

17. The accumulator as in claim 1, wherein the circular bead is continuous around the return conduit.

18. The accumulator as in claim 9, wherein the return conduit has a cylindrical shape and the circular bead projects radially-outward from the return conduit.

19. The accumulator as in claim 9, wherein the circular bead is spaced from the first end of the return conduit.

20. The accumulator as in claim 9, wherein the circular bead is continuous around the return conduit.

21. The method as in claim 13, wherein the return conduit has a cylindrical shape and the circular bead projects radially-outward from the return conduit.

22. The method as in claim 13, wherein the circular bead is spaced from the one end of the return conduit.

23. The method as in claim 13, wherein the circular bead is continuous around the return conduit.

* * * * *